US010289050B2

(12) United States Patent
Shibasaki et al.

(10) Patent No.: US 10,289,050 B2
(45) Date of Patent: May 14, 2019

(54) BINDING DEVICE INCLUDING BINDERS ASSOCIATED WITH DIFFERENT MAXIMUM BUNDLE THICKNESSES AND IMAGE FORMING APPARATUS INCORPORATING SAME

(71) Applicants: Yuusuke Shibasaki, Miyagi (JP); Nobuyoshi Suzuki, Tokyo (JP); Wataru Takahashi, Tokyo (JP); Koki Sakano, Kanagawa (JP)

(72) Inventors: Yuusuke Shibasaki, Miyagi (JP); Nobuyoshi Suzuki, Tokyo (JP); Wataru Takahashi, Tokyo (JP); Koki Sakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/904,778

(22) Filed: Feb. 26, 2018

(65) Prior Publication Data

US 2018/0259895 A1 Sep. 13, 2018

(30) Foreign Application Priority Data

Mar. 8, 2017 (JP) ..... 2017-043390

(51) Int. Cl.

| | |
|---|---|
| ***B65H 31/34*** | (2006.01) |
| ***G03G 15/00*** | (2006.01) |
| ***B65H 37/04*** | (2006.01) |

(52) U.S. Cl.

CPC ..... *G03G 15/6541* (2013.01); *B65H 31/34* (2013.01); *B65H 37/04* (2013.01);
(Continued)

(58) Field of Classification Search

CPC ..... G03G 15/6541; G03G 15/6547; B65H 31/34; B65H 37/04

See application file for complete search history.

(56) References Cited

U.S. PATENT DOCUMENTS 5,187,534 A * 2/1993 Iwata ..... B42C 1/125 227/155
5,478,062 A * 12/1995 Horiuchi ..... B42C 1/12 270/58.08

(Continued)

FOREIGN PATENT DOCUMENTS

| | | |
|---|---|---|
| JP | 2013-216451 | 10/2013 |
| JP | 2015-013725 | 1/2015 |

*Primary Examiner* — Patrick H Mackey

(74) *Attorney, Agent, or Firm* — Harness, Dickey & Pierce, P.L.C.

(57) ABSTRACT

A binding device includes a receptacle, an aligner, a moving mechanism, first and second binders, and a guide. The aligner aligns a bundle of recording media in a width direction thereof on the receptacle. The moving mechanism moves the aligner in the width direction. A maximum thickness of the bundle of recording media boundable in the second binder is smaller than that in the first binder. The guide is movable conforming to the maximum thickness of the bundle of recording media boundable in the first binder, and conforming to that in the second binder, to guide and direct the bundle of recording media to a receiving portion of the first binder when the first binder binds the bundle of recording media, and to a receiving portion of the second binder when the second binder binds the bundle of recording media, respectively. The guide is movable in conjunction with the aligner.

13 Claims, 7 Drawing Sheets

(52) U.S. Cl.
CPC ..... *G03G 15/6547* (2013.01); *B65H 2301/51611* (2013.01); *B65H 2301/51616* (2013.01); *B65H 2408/1222* (2013.01); *B65H 2553/45* (2013.01); *B65H 2801/27* (2013.01)

(56) References Cited

U.S. PATENT DOCUMENTS

| | | | | |
|---|---|---|---|---|
| 6,145,825 | A * | 11/2000 | Kunihiro | B42C 1/12 227/29 |
| 6,550,757 | B2 * | 4/2003 | Sesek | B27F 7/17 227/2 |
| 6,773,004 | B2 * | 8/2004 | Obregon | B42C 1/125 227/5 |
| 9,400,173 | B2 * | 7/2016 | Balili | G01B 11/0608 |
| 2003/0215275 | A1 | 11/2003 | Tamura et al. | |
| 2014/0077437 | A1 * | 3/2014 | Abe | G03G 15/6541 270/58.12 |
| 2015/0093214 | A1 * | 4/2015 | Takahashi | B42B 5/00 412/33 |
| 2016/0114999 | A1 | 4/2016 | Suzuki et al. | |
| 2016/0340144 | A1 * | 11/2016 | Sakano | B65H 37/04 |
| 2016/0340145 | A1 | 11/2016 | Kunieda et al. | |
| 2016/0360053 | A1 | 12/2016 | Suzuki et al. | |
| 2017/0174465 | A1 | 6/2017 | Morinaga et al. | |
| 2017/0217239 | A1 | 8/2017 | Suzuki et al. | |

* cited by examiner

BINDING DEVICE INCLUDING BINDERS ASSOCIATED WITH DIFFERENT MAXIMUM BUNDLE THICKNESSES AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application No. 2017-043390, filed on Mar. 8, 2017, in the Japan Patent Office, the entire disclosure of which is hereby incorporated by reference herein.

BACKGROUND

Technical Field

Embodiments of the present disclosure generally relate to a binding device and an image forming apparatus incorporating the binding device, and more particularly, to a binding device to bind a bundle of recording media and an image forming apparatus to form an image on a recording medium.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

Such image forming apparatuses may include a binding device that includes a stapler and a staple-free binder to perform a binding process with or without a staple.

In addition, the binding device often includes a movable guide that guides a bundle of recording media to the stapler or the staple-free binder.

SUMMARY

In one embodiment of the present disclosure, a novel binding device includes a receptacle, an aligner, a moving mechanism, a first binder, a second binder, and a guide. A plurality of recording media is stacked on the receptacle as a bundle of recording media. The aligner aligns a position of the bundle of recording media in a width direction of the bundle of recording media on the receptacle. The moving mechanism moves the aligner in the width direction of the bundle of recording media. The first binder binds the bundle of recording media on the receptacle. The second binder binds the bundle of recording media on the receptacle. A maximum thickness of the bundle of recording media boundable in the second binder is smaller than a maximum thickness of the bundle of recording media boundable in the first binder. The guide is movable conforming to the maximum thickness of the bundle of recording media boundable in the first binder to guide and direct the bundle of recording media stacked on the receptacle to a receiving portion of the first binder when the first binder binds the bundle of recording media. The guide is movable conforming to the maximum thickness of the bundle of recording media boundable in the second binder to guide and direct the bundle of recording media stacked on the receptacle to a receiving portion of the second binder when the second binder binds the bundle of recording media. The guide is movable in conjunction with the aligner moved by the moving mechanism in the width direction of the bundle of recording media.

Also described is a novel image forming apparatus incorporating the binding device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
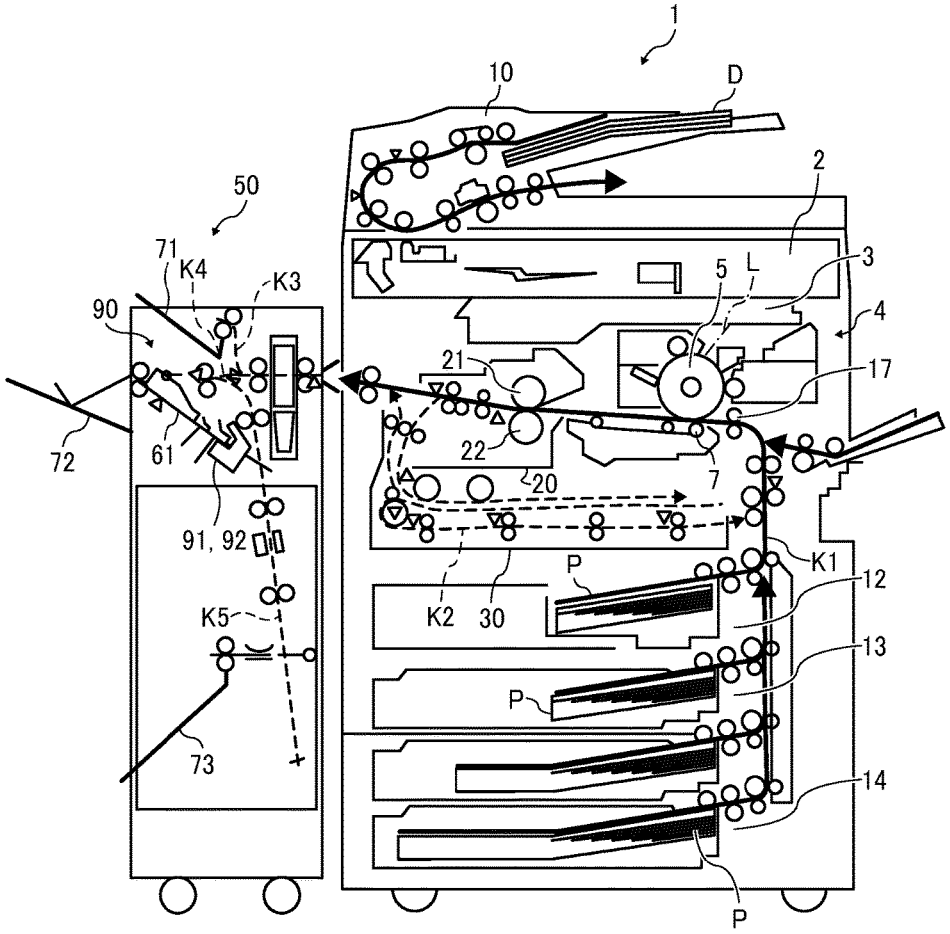
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Initially with reference to FIG. 1, a description is given of overall configuration and operation of an image forming apparatus 1 according to an embodiment of the present disclosure.

FIG. 1 is a schematic view of the image forming apparatus 1.

The image forming apparatus 1 may be a copier, a facsimile machine, a printer, a multifunction peripheral (MFP) having at least two of copying, printing, scanning, facsimile, and plotter functions, or the like. According to the present embodiment, the image forming apparatus 1 is a copier that forms a toner image on a recording medium by electrophotography.

As illustrated in FIG. 1, the image forming apparatus 1 includes, e.g., a scanner 2, an exposure device 3, an image forming device 4, and a transfer device 7. The scanner (or document reader) 2 optically scans image data of a document D. The exposure device 3 irradiates the photoconductive drum 5 with exposure light L according to the image data scanned by the scanner 2. The image forming device 4 includes a photoconductive drum 5 to form a toner image (or simply an image) on the photoconductive drum 5. The transfer device (or image forming unit) 7 transfers the toner image from the photoconductive drum 5 onto a sheet P serving as a recording medium.

The image forming apparatus 1 further includes a document conveyor 10, sheet feeders 12, 13, and 14, a registration roller pair 17, a fixing device 20, a duplex printing conveyor 30, and a post-processing device 50. The document conveyor 10 conveys the document D set thereon to the scanner 2. The sheet feeders 12, 13, and 14 accommodate sheets P. The registration roller pair (or timing roller pair) 17 conveys the sheets P toward the transfer device 7 one by one. The fixing device 20 includes, e.g., a fixing roller 21 and a pressure roller 22 to fix a toner image onto the sheet P. The duplex printing conveyor 30 reverses the sheet P bearing the fixed toner image on a front side thereof and conveys the sheet P thus reversed toward the transfer device 7.

The post-processing device (or sheet processing device) 50 performs post processing on the sheet P ejected from a main body of the image forming apparatus 1 and entering into the post-processing device 50. The post-processing device 50 includes an inner tray 61 serving as a receptacle, a first output tray 71, a second output tray 72, a third output tray 73, and a binding device 90. After the post processing, the sheet P (or a bundle of sheets PT) is ejected and stacked on the first output tray 71, the second output tray 72, or the third output tray 73. The binding device 90 includes a first binder 91 and a second binder 92. The post-processing device 50 is removable from the main body of the image forming apparatus 1.

With continued reference to FIG. 1, a description is now given of a basic image forming operation of the image forming apparatus 1.

Firstly, a plurality of conveyance roller pairs of the document conveyor 10 conveys the document D from a document tray in a direction indicated by an arrow in FIG. 1. The document D thus conveyed passes over the scanner 2. At this time, the scanner 2 optically scans image data of the document D passing over the scanner 2.

The image data optically scanned by the scanner 2 is converted into electrical signals. The electrical signals are transmitted to the exposure device 3 serving as a writer. The exposure device 3 then emits exposure light L, such as laser light, according to the electrical signals (i.e., image data) toward the surface of the photoconductive drum 5 disposed in the image forming device 4.

Meanwhile, while the photoconductive drum 5 rotates in a clockwise direction in FIG. 1, the image forming device 4 performs a predetermined series of image forming processes, such as a charging process, an exposing process, and a developing process, to form a toner image corresponding to the image data on the photoconductive drum 5.

Thereafter, the transfer device 7 serving as an image forming unit transfers the toner image from the surface of the photoconductive drum 5 onto a sheet P conveyed by the registration roller pair 17.

Now, a description is given of how the sheet P is conveyed to the transfer device 7.

Firstly, one of the sheet feeders 12, 13, and 14 disposed inside the main body of the image forming apparatus 1 is selected automatically or manually. For example, if the uppermost sheet feeder 12 is selected, then, an uppermost sheet P of a plurality of sheets P accommodated in the sheet feeder 12 is conveyed toward a first conveyance passage K1 along which a plurality of conveyance roller pairs are disposed.

The plurality of conveyance roller pairs conveys the sheet P along the first conveyance passage K1 to the registration roller pair 17. Activation of the registration roller pair 17 is timed to send out the sheet P toward the transfer device 7 such that the sheet P meets the toner image formed on the photoconductive drum 5 at an area of contact, herein referred to as a transfer nip, between the transfer device 7 and the photoconductive drum 5.

After the transfer device 7 transfers the toner image from the photoconductive drum 5 onto the sheet P, the sheet P is conveyed to the fixing device 20 along a sheet conveyance passage. In the fixing device 20, the sheet P is heated by the fixing roller 21 and pressed by the fixing roller 21 and the pressure roller 22 while the sheet P is conveyed through an area of contact, herein referred to as a fixing nip, between the fixing roller 21 and the pressure roller 22. Thus, the fixing device 20 fixes the toner image onto the sheet P at the fixing nip. After being ejected from the fixing nip, the sheet P bearing the fixed toner image is ejected from the main body of the image forming apparatus 1 if "one-side printing mode" is selected to form an image on one side of the sheet P.

By contrast, if "duplex printing mode" is selected to form images on both sides (i.e., front side and back side) of the sheet P, the sheet P bearing the fixed toner image on the front side thereof is not ejected from the main body of the image forming apparatus 1 after being ejected from the fixing nip. Instead, the sheet P is directed to a second conveyance passage K2 after being ejected from the fixing nip. Specifically, the duplex printing conveyor 30 reverses a direction in which the sheet P is conveyed (hereinafter referred to as a conveyance direction or a sheet conveyance direction), thereby reversing the sheet P. Then, the duplex printing conveyor 30 conveys the sheet P along the second conveyance passage K2 toward the transfer device 7. Then, following the image forming process described above, another toner image is formed on the back side of the sheet P at the transfer nip. The fixing device 20 fixes the toner image onto the back side of the sheet P. Then, the sheet P bearing the fixed toner images on both sides thereof is conveyed along a sheet conveyance passage and ejected from the main body of the image forming apparatus 1.

In the present embodiment, as described above, the image forming apparatus 1 includes the post-processing device 50. After being ejected from the main body of the image forming apparatus 1, the sheet P is conveyed to the post-processing device 50, which performs post processing on the sheet P.

Figure 2:
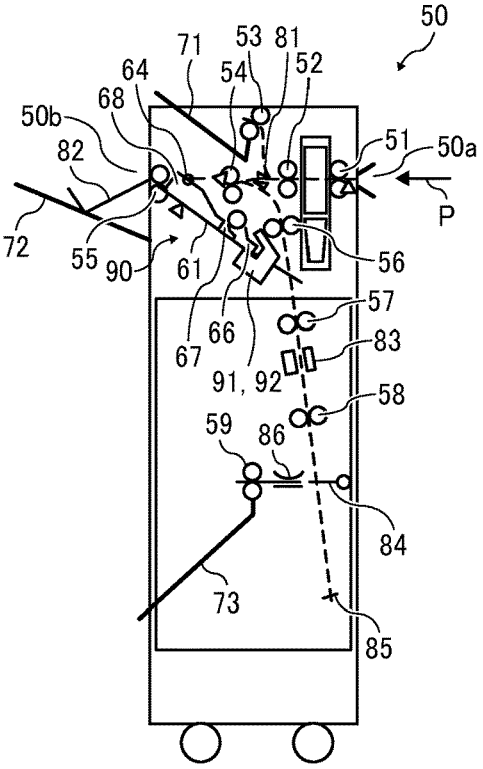
FIG. 2 is a schematic view of a post-processing device incorporated in the image forming apparatus of FIG. 1.

With continued reference to FIG. 1, a description is now given of the post processing performed by the post-processing device 50. In the present embodiment, the post-processing device 50 conveys the sheet P coming from the main body of the image forming apparatus 1 to one of a third conveyance passages K3, a fourth conveyance passages K4, and a fifth conveyance passages K5 to perform different kinds of post processing. Specifically, the third conveyance passage K3 is a conveyance passage for ejecting the sheet P coming from the main body of the image forming apparatus 1 onto the first output tray 71 as it is without performing post processing onto the sheet P. The fourth conveyance passage K4 is a conveyance passage for loading the sheet P coming from the main body of the image forming apparatus 1 onto the inner tray 61. As described above, the post-processing device 50 includes the binding device 90 (hereinafter referred to as a first binding device 90). The first binding device 90 includes two binders, namely, the first binder 91 and the second binder 92. One of the first binder 91 and the second binder 92 binds a trailing end portion of a plurality of sheets P stacked on the inner tray 61 in a binding process. After the binding process, an output roller pair 55 ejects the plurality of sheets P (or bundle of sheets PT) onto the second output tray (or external tray) 72 via an ejection port 50*b*. The fifth conveyance passage K5 is a conveyance passage for binding and folding a plurality of sheets P. Specifically, the sheet P coming from the main body of the image forming apparatus 1 is temporarily conveyed along the fourth conveyance passage K4 to be switched back. The sheet P thus switched back is conveyed along the fifth conveyance passage K5. As illustrated in FIG. 2, a second binding device 83 and a sheet folding blade 84 are disposed along the fifth conveyance passage K5, for example. The second binding device 83 binds a center portion of a plurality of sheets P. The sheet folding blade 84 folds the plurality of sheets P thus bound. After being bound and folded, the plurality of sheets P is ejected onto the third output tray 73.

Note that a bifurcating claw 81 rotates to direct the sheet P toward one of the third conveyance passage K3, the fourth conveyance passage K4, and the fifth conveyance passage K5.

Referring now to FIG. 2, a detailed description is given of conveyance of the sheet P along the third conveyance passage K3, the fourth conveyance passage K4, and the fifth conveyance passage K5.

FIG. 2 is a schematic view of the post-processing device 50 incorporated in the image forming apparatus 1 described above.

A first conveyance roller pair 51, a sheet detection sensor, and the like are disposed near a sheet entrance 50*a* of the post-processing device 50. The first conveyance roller pair 51 and a second conveyance roller pair 52 convey the sheet P detected by the sheet detection sensor into the post-processing device 50. Then, according to a post-processing mode manually selected in advance, the bifurcating claw 81 rotates to direct the sheet P to a desired one of the third conveyance passage K3, the fourth conveyance passage K4, and the fifth conveyance passage K5.

If "no post-processing mode" is selected for not performing post processing, the sheet P is conveyed along the third conveyance passage K3 and ejected by a third conveyance roller pair 53 onto the first output tray 71.

If "sort mode (or sorting mode)" is selected, the sheets P are conveyed along the fourth conveyance passage K4. A fourth conveyance roller pair 54, which is movable in a sheet width direction (i.e., direction perpendicular to the surface of the paper on which FIG. 2 is drawn) conveys the sheets P to the output roller pair 55, serving as a fifth conveyance roller pair, while shifting the sheets P one by one for a predetermined distance in the sheet width direction. The output roller pair 55 ejects the sheets P one by one onto the second output tray 72. Thus, the sheets P lie stacked on the second output tray 72.

As illustrated in FIG. 2, a feeler 82 is rotatable about an upper end pivot above the second output tray 72. A moving mechanism vertically moves the second output tray 72. A sensor is disposed near the pivot of the feeler 82 to detect that the feeler 82 contacts the sheets P sequentially stacked on the second output tray 72. Specifically, the sensor detects that the feeler 82 contacts the center portion of the sheets P in the conveyance direction thereof. Accordingly, the height of the sheets P stacked on the second output tray 72 is recognized. The vertical position of the second output tray 72 is adjusted according to an increase or decrease in the number of sheets P stacked on the second output tray 72. When the vertical position of the second output tray 72 reaches a lower limit position, it is determined that the number of sheets P stacked on the second output tray 72 has reached an upper limit (i.e., maximum). Accordingly, the post-processing device 50 transmits a stop signal to a controller of the image forming apparatus 1, thereby stopping the image forming operation.

Figure 3:
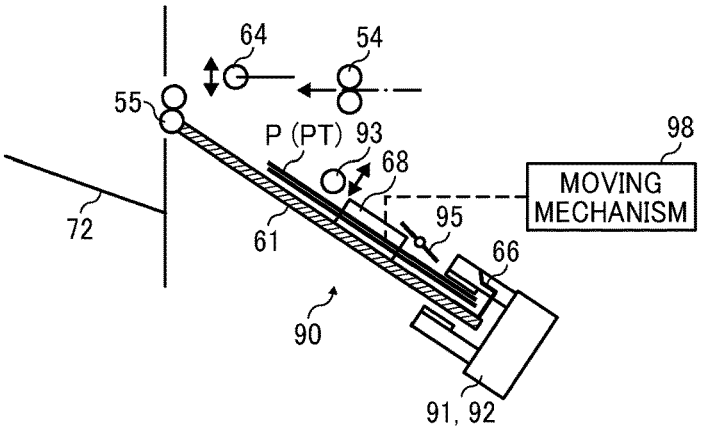
FIG. 3 is a schematic view of a binding device incorporated in the post-processing device of FIG. 2.

If "binding mode (or stapling mode)" is selected, the sheets P are conveyed along the fourth conveyance passage K4. The fourth conveyance roller pair 54 conveys the sheets P one by one onto the inner tray 61 without shifting the sheets P. As illustrated in FIGS. 2 and 3, a tapping roller 64 and an auxiliary conveyance roller 93 are disposed above the inner tray 61. Each time when the sheet P is placed on a placement face of the inner tray 61, the tapping roller 64 moves from a retracted position to a position where the tapping roller 64 contacts an uppermost sheet P. Similarly, the auxiliary conveyance roller 93 moves from a retracted position to a position where the auxiliary conveyance roller 93 contacts the uppermost sheet P. Then, the tapping roller 64 and the auxiliary conveyance roller 93 are rotated in a clockwise direction in FIGS. 2 and 3 to convey or move the uppermost sheet P toward an end fence 66. As a consequence, the trailing end portion of each of the sheets P in the conveyance direction thereof strikes the end fence 66. Thus, the positions of the sheets P are aligned in the conveyance direction thereof. In other words, the position of the bundle of sheets PT is aligned in the conveyance direction thereof.

Referring to FIGS. 2 through 4B, a side fence pair (or a jogger fence pair) 68 is disposed on opposed ends of the inner tray 61 in a width direction thereof. Note that the width direction of the inner tray 61 is parallel to the sheet width direction (i.e., width direction of the sheets P) Each time when the sheet P is loaded on the inner tray 61 (or after a desired number of sheets P are loaded on the inner tray 61), the side fence pair 68 moves in the width direction thereof so as to sandwich the sheet P (or the bundle of sheets PT), thereby aligning the position of the sheet P (or the bundle of sheets PT) in the width direction thereof. Then, the first binding device 90 performs a binding process on the trailing end portion of the bundle of sheets PT aligned in the conveyance direction and the width direction thereof.

Thereafter, a release claw 67 moves in a direction to eject the bundle of sheets PT thus bound. Accordingly, the bundle of sheets PT is moved obliquely upward along the inclination of the placement face of the inner tray 61. Lastly, the output roller pair 55 conveys the bundle of sheets P onto the second output tray 72.

Note that, in the present embodiment, the first binding device 90 includes two binders, namely, the first binder 91 and the second binder 92. One of the first binder 91 and the second binder 92 is selected to bind the bundle of sheets PT. The bundle of sheets PT is directed toward a receiving portion of the selected one of the first binder 91 and the second binder 92 while being guided by a movable guide 95. A detailed description thereof is deferred.

If "folding mode" is selected, the sheets P are firstly conveyed to the fourth conveyance passage K4 so that the fourth conveyance roller pair 54 conveys the sheets P toward the fifth conveyance passage K5. Specifically, while sandwiching the trailing end portion of the sheet P, the fourth conveyance roller pair 54 is rotated in a backward direction to switch back the sheet P, thereby conveying the sheet P toward the fifth conveyance passage K5. A sixth conveyance roller pair 56, a seventh conveyance roller pair 57, and an eighth conveyance roller pair 58 convey the sheet P along the fifth conveyance passage K5 to a position where the center position of the sheet P faces the second binding device 83 (i.e., position where a conveyance guide plate functions as a receptacle). Then, after a desired number of sheets P lie stacked at the position as a bundle of sheets PT, the second binding device 83 binds the center portion of the bundle of sheets PT. Thereafter, the seventh conveyance roller pair 57 and the eighth conveyance roller pair 58 convey the bundle of sheets PT to a position where the center portion of the bundle of sheets PT faces the sheet folding blade 84. At the position, a leading end portion of the bundle of sheets PT is in contact with a stopper 85, which is movable by a moving mechanism in the conveyance direction of the bundle of sheets PT.

The sheet folding blade 84 moves leftward in FIG. 2, thereby folding the center portion of the bundle of sheets PT. The folded portion of the bundle of sheets PT is pressed against a sheet folding plate 86. Thus, the bundle of the sheets PT is folded. Thereafter, a ninth conveyance roller pair 59 conveys and ejects the bundle of sheets PT onto the third output tray 73.

Referring now to FIGS. 3 through 16B, a description is given of the first binding device 90 of the present embodiment.

FIG. 3 is a schematic view of the first binding device 90 incorporated in the post-processing device 50 described above.

Figure 4A:
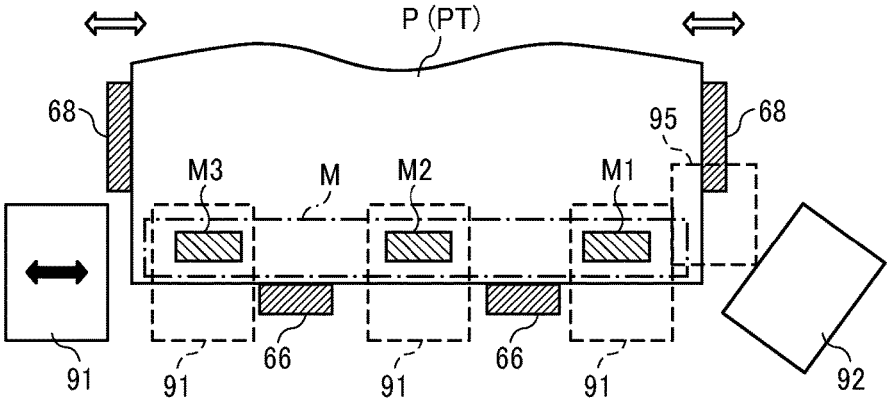
FIG. 4A is a schematic top view of a main part of the binding device in a width direction thereof, illustrating how a first binder incorporated in the binding device moves.
Figure 4B:
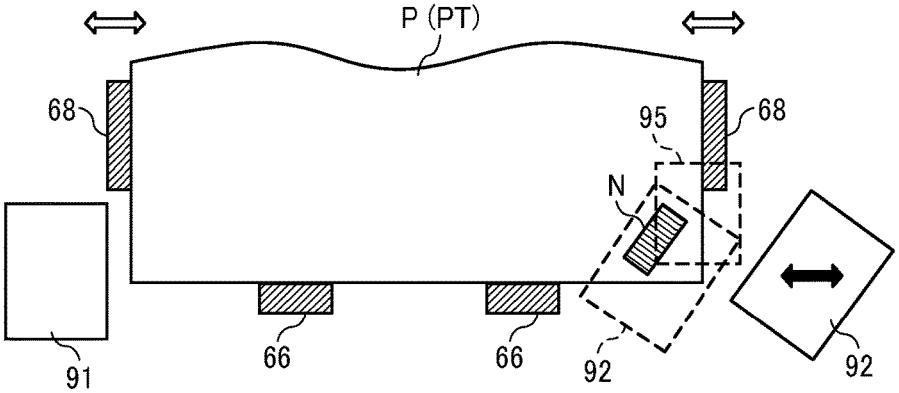
FIG. 4B is a schematic top view of the main part of the binding device in the width direction thereof, illustrating how a second binder incorporated in the binding device moves.

As described above with reference to FIGS. 1 and 2, the post-processing device 50 of the present embodiment includes the first binding device 90 that binds a bundle of sheets PT. The first binding device 90 includes, e.g., the inner tray 61, the side fence pair 68, the end fence 66, the first binder 91, and the second binder 92. Specifically, the inner tray 61 serves as a receptacle to stack a plurality of sheets P as a bundle of sheets PT. The side fence pair 68 serves as an aligner that aligns a position of the bundle of sheets PT in the width direction thereof on the inner tray 61. Note that the width direction of the bundle of sheets PT is perpendicular to the surface of the paper on which FIGS. 2 and 3 are drawn, and is illustrated horizontally in FIGS. 4A and 4B. The end fence 66 serves as an aligner that aligns the position of the bundle of sheets PT in the conveyance direction thereof on the inner tray 61. Note that the conveyance direction of the bundle of sheets PT is perpendicular to the width direction thereof. The conveyance direction of the bundle of sheets PT is illustrated as a direction along the placement face of the inner tray 61 in FIGS. 2 and 3, and is illustrated vertically in FIGS. 4A and 4B. As illustrated in FIG. 4A, the first binder 91 binds binding portions M1 through M3 of a binding area M of the plurality of sheets P as a bundle of sheets PT. By contrast, as illustrated in FIG. 4B, the second binder 92 binds a binding portion N of the plurality of sheets P as a bundle of sheets PT.

More specifically, the inner tray 61 is disposed such that the placement face thereof inclines upward from an end (i.e., right end in FIGS. 2 and 3) to the other end (i.e., left end in FIGS. 2 and 3). The inner tray 61 functions as a receptacle to stack a plurality of sheets as a bundle of sheets. Away from the ejection port 50*b* and below the inclined placement face of the inner tray 61 are the first binder 91 and the second binder 92. The first binding device 90 performs a binding process of biding the bundle of sheets PT with the first binder 91 and the second binder 92. Specifically, the first binding device 90 has a predetermined range as a binding area along the width direction of the bundle of sheets PT.

The moving mechanism 98 moves the side fence pair 68 in the sheet width direction (i.e., width direction of the bundle of sheets PT). The side fence pair 68 is constructed of two side fences provided on opposed ends of the inner tray 61 in the width direction thereof so as to sandwich the bundle of sheets PT. The moving mechanism 98 may be configured to move the two side fences in opposite directions in the sheet width direction at one time, thereby adjusting the distance between the two side fences. In the present embodiment, the side fence pair 68 is configured such that the two side fences are individually movable at different times. Specifically, the moving mechanism 98 includes two drivers that respectively move the two side fences in the sheet width direction. Each of the first driver and the second driver may include, e.g., a motor-driven worm gear that meshes with a rack gear formed on the side fence pair 68.

As described above, in the present embodiment, the first binding device 90 includes two binders, namely, the first binder 91 and the second binder 92.

Referring now to FIGS. 4A and 4B, a detailed description is given of the first binder 91 and the second binder 92.

FIG. 4A is a schematic top view of a main part of the first binding device 90 in a width direction thereof, illustrating how the first binder 91 moves. FIG. 4B is a schematic top view of the main part of the first binding device 90 in the width direction thereof, illustrating how the second binder 92 moves.

Note that the width direction of the first binding device 90 is parallel to the sheet width direction. In other words, the width direction of the first binding device 90 is perpendicular to the surface of the paper on which FIG. 3 is drawn, and is illustrated horizontally in FIGS. 4A and 4B.

When not performing a binding process, the first binder 91 is retracted on one side in the width direction of the first binding device 90 while the second binder 92 is retracted on the other side in the width direction of the first binding device 90. The first binder 91 is configured to perform a binding process (or binding process operation) with a staple (e.g., metal staple). By contrast, the second binder 92 is configured to perform a binding process (or binding process operation) without a staple (e.g., metal staple). The first binding device 90 includes a first guide shaft and a second guide shaft serving as guides that guide the first binder 91 and the second binder 92, respectively. Specifically, the first guide shaft guides the first binder 91 such that the first binder 91 moves in a predetermined direction parallel to the width direction of the first binding device 90 and perpendicular to the sheet conveyance direction. On the other hand, the second guide shaft guides the second binder 92 such that the second binder 92 moves in a predetermined direction parallel to the width direction of the first binding device 90 and perpendicular to the sheet conveyance direction.

Referring now to FIG. 4A, a detailed description is given of the first binder 91.

The first binder 91 binds the bundle of sheets PT stacked on the inner tray 61 with a staple.

Specifically, when a first driver or moving mechanism transmits a driving force to the first binder 91, the first binder 91 moves from a first reference position, which is indicated by a solid line in FIG. 4A and located on a first end side in the width direction of the bundle of sheets PT stacked on the inner tray 61, toward a second end side in the width direction of the bundle of sheets PT. In this case, the first binder 91 moves rightward from the first reference position in FIG. 4A. Then, the first binder 91 performs a binding process on the binding portions M1 through M3 of the bundle of sheets PT with staples.

More specifically, in the present embodiment, the first binder 91 binds the three binding portions M1 through M3 into which the binding area M is divided. The binding area M is substantially an entire area of an end portion of the bundle of sheets PT in the conveyance direction thereof. The bundle of sheets PT is positioned by the side fence pair 68 and the end fence 66 in the sheet width direction and the sheet conveyance direction, respectively. Note that the sheet conveyance direction (i.e., conveyance direction of the bundle of sheets PT) is illustrated vertically in FIG. 4A. Among the three binding portions M1 through M3, in the present embodiment, the first binder 91 performs a binding process on the binding portion M3 (hereinafter referred to as a first binding portion M3) at first. Specifically, the first binder 91 moves from the first reference position, which is located to the left of the left end of the bundle of sheets PT in FIG. 4A, to the position of the first binding portion M3 as indicated by a broken line in FIG. 4A. As illustrated in FIG. 4A, the first binding portion M3 is located on the left (i.e., first end side in the sheet width direction) in the binding area M. Secondly, the first binder 91 moves toward the position of the binding portion M2 (hereinafter referred to as a second binding portion M2) as indicated by a broken line in FIG. 4A, thereby performing a binding process on the second binding portion M2. As illustrated in FIG. 4A, the second binding portion M2 is adjacent to the first binding portion M3 and located to the right side of the first binding portion M3. In short, the second binding portion M2 is located in the middle of the binding area M in the sheet width direction. Lastly, the first binder 91 moves toward the position of the binding portion M1 (hereinafter referred to as a third binding portion M1) as indicated by a broken line in FIG. 4A, thereby performing a binding process on the third binding portion M1. As illustrated in FIG. 4A, the third binding portion M1 is adjacent to the second binding portion M2 and located to the right side of the second binding portion M2. In short, the third binding portion M1 is located on the right (i.e., second end side in the sheet width direction) in the binding area M. Thereafter, the first binder 91 moves in the opposite direction to return to the first reference position.

Note that, in the present embodiment, the first binder 91 performs a binding process on the three binding portions M1 through M3 into which the binding area M is almost evenly divided in the sheet width direction. The number and locations of the binding portions are not limited to those described above. The binding process can be performed in various forms.

As the first binder 91 that performs a binding process with a metal staple, a general binder may be used.

Figure 5:
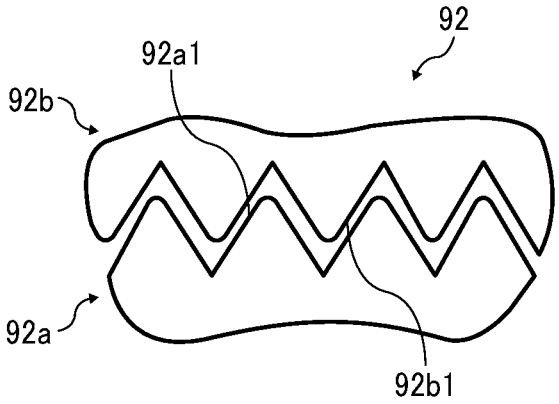
FIG. 5 is an enlarged view of the second binder, illustrating uneven portions thereof.

Referring now to FIGS. 4B and 5, a detailed description is given of the second binder 92.

FIG. 5 is an enlarged view of the second binder 92, illustrating uneven portions thereof.

Unlike the first binder 91 described above, the second binder 92 binds the bundle of sheets PT stacked on the inner tray 61 without staples.

Specifically, when a second driver or moving mechanism transmits a driving force to the second binder 92, the second binder 92 moves from a second reference position, which is indicated by a solid line in FIG. 4B and located on the second end side in the width direction of the bundle of sheets PT stacked on the inner tray 61, toward the first end side in the width direction of the bundle of sheets PT. In this case, the second binder 92 moves leftward from the second reference position in FIG. 4B. Then, the second binder 92 performs a binding process on the binding portion N of the bundle of sheets PT without a staple.

More specifically, as illustrated in FIG. 5, the second binder 92 is constructed of a first portion 92*a* and a second portion 92*b*, which are almost vertically disposed. An upper surface of the first portion 92*a* is a toothed uneven portion 92*a*1. A lower surface of the second portion 92*b* is a toothed uneven portion 92*b*1 that meshes with the toothed uneven portion 92*a*1 of the first portion 92*a*. The second portion 92*b* is movable relative to the first portion 92*a* so as to sandwich the bundle of sheets PT between the first portion 92*a* and the second portion 92*b*. The second binder 92 presses the toothed uneven portion 92*a*1 and the toothed uneven portion 92*b*1 against the bundle of sheets PT, thereby forming unevenness in the bundle of sheets PT in a thickness direction thereof such that the sheets P mesh with each other. Thus, the second binder 92 binds the bundle of sheets PT. In other words, the second binder 92 performs a binding process while sandwiching the bundle of sheets PT between the first portion 92*a* and the second portion 92*b*.

As illustrated in FIG. 4B, in the present embodiment, the second binder 92 binds the binding portion N, which is a part (more specifically, a corner) of an end portion of the bundle of sheets PT in the conveyance direction thereof. As described above, the bundle of sheets PT is positioned by the side fence pair 68 and the end fence 66 in the sheet width direction and the sheet conveyance direction, respectively. The sheet conveyance direction (i.e., conveyance direction of the bundle of sheets PT) is illustrated vertically in FIG. 4B. Specifically, in the present embodiment, the second binder 92 moves from the second reference position, which is located to the right of the right end of the bundle of sheets PT in FIG. 4B, to the position of the binding portion N (or corner binding portion N) as indicated by a broken line in FIG. 4B. As illustrated in FIG. 4B, the corner binding portion N is located to the left of the second reference position. Then, the second binder 92 performs a binding process on the corner binding portion N. Thereafter, the second binder 92 moves in the opposite direction to return to the second reference position.

Note that, in the present embodiment, the second binder 92 performs a binding process on the single binding portion N located at one corner of the bundle of sheets PT. The number and location of the binding portion are not limited to those described above. The binding process can be performed in various forms.

In the present embodiment, the second binder 92 is movable between the second reference position and the position of the binding portion N. Alternatively, the second binder 92 may be fixed at the position of the binding portion N to perform a binding process. Alternatively, the second binder 92 may be fixed at the second reference position to perform a binding process. In this case, the bundle of sheets PT may be moved so that the second binder 92 performs a binding process on the bundle of sheets PT.

Referring now to FIGS. 6A through 16B, a detailed description is given of characteristic configuration and operation of the first binding device 90 according to the present embodiment.

Figure 6A:
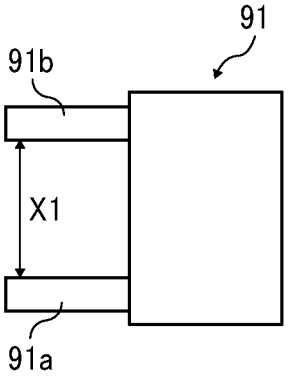
FIG. 6A is a schematic view of the first binder, illustrating a size of an entrance of a receiving portion thereof.
Figure 6B:
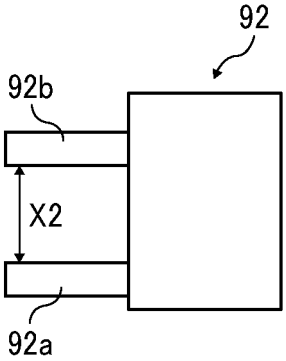
FIG. 6B is a schematic view of the second binder, illustrating a size of an entrance of a receiving portion thereof.

FIG. 6A is a schematic view of the first binder 91, illustrating a size X1 of an entrance of a receiving portion thereof. FIG. 6B is a schematic view of the second binder 92, illustrating a size X2 of an entrance of a receiving portion thereof.

As described above, the first binding device 90 of the present embodiment includes the first binder 91 and the second binder 92. The first binder 91 is configured to bind the bundle of sheets PT with a staple. The second binder 92 is configured to bind the bundle of sheets PT without a staple.

In the present embodiment, a maximum thickness of the bundle of sheets PT boundable in the second binder 92 is smaller than a maximum thickness of the bundle of sheets PT boundable in the first binder 91. In other words, an upper limit of thickness of the bundle of sheets PT that can be bound by the first binder 91 is different from an upper limit of thickness of the bundle of sheets PT that can be bound by the second binder 92. Specifically, the maximum thickness (i.e., upper limit of thickness) of the bundle of sheets PT boundable in the first binder 91 with a staple depends on the length of the staple, more specifically, the length of opposed legs of the U-shaped staple. By contrast, the maximum thickness (i.e., upper limit of thickness) of the bundle of sheets PT boundable in the second binder 92 without a staple depends on, e.g., the height of teeth of the toothed uneven portions 92*a*1 and 92*b*1.

FIG. 6A illustrates the size X1 of the entrance of the receiving portion of the first binder 91 between a first portion 91*a* and a second portion 91*b*. FIG. 6B illustrates the size X2 of the entrance of the receiving portion of the second binder 92 between the first portion 92*a* and the second portion 92*b*. As illustrated in FIGS. 6A and 6B, the size X1 is greater than the size X2 (i.e., X1>X2).

In the present embodiment, as illustrated in FIG. 3 and FIGS. 7A through 16B, the first binding device 90 includes the movable guide 95 that guides the bundle of sheets PT toward the receiving portion of one of the first binder 91 and the second binder 92 that performs a binding process.

Specifically, the movable guide 95 is movable conforming to the maximum thickness of the bundle of sheets PT boundable in the first binder 91 (i.e., size X1 of the entrance) to guide and direct the bundle of sheets PT stacked on the inner tray 61 to the receiving portion of the first binder 91 when the first binder 91 binds the bundle of sheets PT. On the other hand, the movable guide 95 is movable conforming to the maximum thickness of the bundle of sheets PT boundable in the second binder 92 (i.e., size X2 of the entrance) to guide and direct the bundle of sheets PT stacked on the inner tray 61 to the receiving portion of the second binder 92 when the second binder 92 binds the bundle of sheets PT.

In short, when the first binder 91 performs a binding process, the movable guide 95 moves conforming to the size X1 of the entrance of the receiving portion of the first binder 91. On the other hand, when the second binder 92 performs a binding process, the movable guide 95 moves conforming to the size X2 of the entrance of the receiving portion of the second binder 92.

In the present embodiment, the movable guide 95 is movable in conjunction with the side fence pair 68 moved by the moving mechanism 98 in the sheet width direction (i.e., width direction of the bundle of sheets PT).

Specifically, the movable guide 95 is rotatable about a pivot 95*a*. As the moving mechanism 98 moves the side fence pair 68 in the sheet width direction, the side fence pair 68 pushes the movable guide 95, thereby rotating the movable guide 95 about the pivot 95*a*. In other words, the side fence pair 68 moved by the moving mechanism 98 in the width direction of the bundle of sheets PT pushes and rotates the movable guide 95 about the pivot 95*a*.

As illustrated in FIGS. 7B, 8B, 9B, 10B, 11B, 12B, 13B, 14B, 15B, and 16B, the pivot 95*a* is disposed between a leading end portion of the movable guide 95 and a trailing end portion of the movable guide 95 in the sheet conveyance direction, which is a direction perpendicular to the sheet width direction (i.e., width direction of the bundle of sheets PT). The leading end portion of the movable guide 95 is located on a binder side where the first binder 91 and the second binder 92 are located while the trailing end portion of the movable guide 95 is located on a side fence side as an aligner side where the side fence pair 68 serving as an aligner is located. The movable guide 95 is held by a housing of the first binding device 90 rotatably about the pivot 95*a*. In the present embodiment, the movable guide 95 is disposed on one end side in the sheet width direction, on which the second binder 92 is disposed.

When the first binder 91 binds the bundle of sheets PT, the side fence pair 68 does not push the trailing end portion of the movable guide 95. On the other hand, the leading end portion of the movable guide 95 is located at a first position conforming to the maximum thickness of the bundle of sheets PT boundable in the first binder 91 (i.e., size X1 of the entrance of the receiving portion of the first binder 91).

Figure 7A:
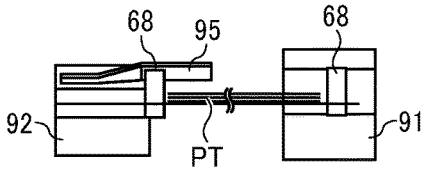
FIG. 7A is a schematic view of the binding device, illustrating a first stage of a binding operation thereof with the first binder in a sheet width direction.
Figure 7B:
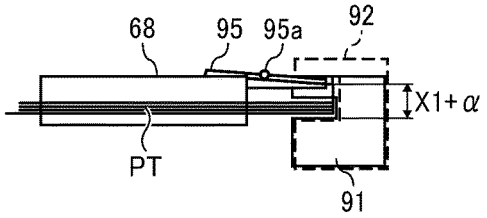
FIG. 7B is a schematic view of the binding device, illustrating the first stage of the binding operation thereof with the first binder in a sheet conveyance direction.

Specifically, as illustrated in FIG. 7B, the inclination of a guide face of the movable guide 95 is relatively gentle downward from above. Note that the guide face of the movable guide 95 faces an upper face of the bundle of sheets PT. A gap between the leading end portion of the movable guide 95 and a lower face of the bundle of sheets PT (the placement face of the inner tray 61 or the upper face of the first portion 91*a* of the receiving portion) is determined to be slightly larger than the size X1 of the entrance of the receiving portion of the first binder 91. In short, the gap is determined to be X1+α.

By contrast, when the second binder 92 binds the bundle of sheets PT, the side fence pair 68 pushes the trailing end portion of the movable guide 95 thereby rotating the movable guide 95 about the pivot 95*a* as the moving mechanism 98 moves the side fence pair 68 in the sheet width direction. In other words, when the second binder 92 binds the bundle of sheets PT, the side fence pair 68 moved by the moving mechanism 98 in the width direction of the bundle of sheets PT pushes the trailing end portion of the movable guide 95 and rotates the movable guide 95 about the pivot 95*a*. Accordingly, the leading end portion of the movable guide 95 moves to a second position (illustrated in FIG. 13B) conforming to the maximum thickness of the bundle of sheets PT boundable in the second binder 92 (i.e., size X2 of the entrance of the receiving portion of the second binder 92). Note that the second position is lower than the first position (illustrated in, e.g., FIGS. 7B and 11B).

Figure 13A:
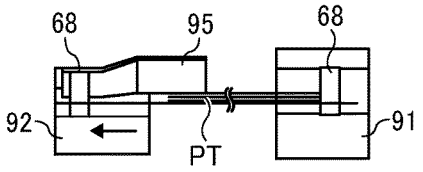
FIG. 13A is a schematic view of the binding device, illustrating a third stage of the binding operation thereof with the second binder in the sheet width direction.
Figure 13B:
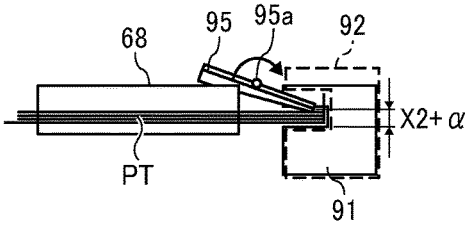
FIG. 13B is a schematic view of the binding device, illustrating the third stage of the binding operation thereof with the second binder in the sheet conveyance direction.

Specifically, as illustrated in FIG. 13B, the inclination of the guide face of the movable guide 95 is relatively steep downward from above. A gap between the leading end portion of the movable guide 95 and the lower face of the bundle of sheets PT (the placement face of the inner tray 61 or the upper face of the first portion 92*a* of the receiving portion) is determined to be slightly larger than the size X2 of the entrance of the receiving portion of the second binder 92. In short, the gap is determined to be X2+α.

The second binder 92 binds the bundle of sheets PT stacked on the inner tray 61 while the side fence pair 68 pushes the trailing end portion of the movable guide 95 to locate the leading end portion of the movable guide 95 at the second position illustrated in FIG. 13B, and while the side fence pair 68 aligns the bundle of sheets PT in the width direction thereof.

Specifically, in the present embodiment, the moving mechanism 98 moves a side fence of the side fence pair 68 (i.e., left side fence 68 illustrated in FIG. 13A) leftward in FIG. 13A, thereby rotating the movable guide 95. Thereafter, the moving mechanism 98 moves the other side fence of the side fence pair 68 (i.e., right side fence 68 illustrated in FIG. 13A) leftward in FIG. 13A. Thus, the side fence pair 68 aligns the bundle of sheets PT in the width direction thereof. The movable guide 95 guides and directs the bundle of sheets PT thus aligned to the receiving portion of the second binder 92 so that the second binder 92 binds the bundle of sheets PT.

Note that, in the present embodiment, as illustrated in FIGS. 7A through 10B, the movable guide 95 stays at the first position due to its own weight (i.e., weight balance) without pressure from the side fence pair 68.

Alternatively, a biasing member (e.g., spring) and a stopper may be disposed to stay the movable guide 95 at the first position. Specifically, the biasing member biases and rotates the movable guide 95 toward the first position. Then, the stopper is engaged with the movable guide 95 thus biased, thereby staying the movable guide 95 at the first position. In such a case, when the side fence pair 68 pushes and rotates the movable guide 95 toward the second position, the movable guide 95 is pushed against the biasing force of the biasing member.

As described above, in the present embodiment, the movable guide 95 moves or rotates conforming to the entrance of the receiving portion of selected one of the first binder 91 and the second binder 92 that can bind different maximum thicknesses of the bundle of sheets PT. Accordingly, the selected one of the first binder 91 and the second binder 92 exhibits enhanced binding operation.

In addition, the movement or rotation of the movable guide 95 is not in conjunction with the movement of the first binder 91 or the second binder 92, but in conjunction with the movement of the side fence pair 68. Therefore, even if the first driver that moves the first binder 91 or the second driver that moves the second binder 92 fails, the other driver capable of performing normal operation moves the corresponding binder to relatively perform a binding process with the movable guide 95 in normal operation.

Further, in the present embodiment, an independent driving source or rotating mechanism is not provided for moving the movable guide 95 alone. The moving mechanism 98

(i.e., driving source) that moves the side fence pair 68 also serves as a moving mechanism that moves the movable guide 95. Therefore, the present embodiment prevents an increase in size and cost of the first binding device 90.

Note that, in the present embodiment, if the moving mechanism 98 that moves the side fence pair 68 fails, the movable guide 95 may fail to rotate to the second position when the second binder 92 performs a binding process. However, in such a case in which the side fence pair 68 fails to move, the bundle of sheets PT is not aligned regardless of which one of the first binder 91 and the second binder 92 performs a binding process. Such a case may require repairs, which does not lead to an increase in the number of times a service man is sent for repairs and maintenance of the first binding device 90 compared to typical binding devices.

In the present embodiment, in response to a failure of one of the first binder 91 and the second binder 92, the other one of the first binder 91 and the second binder 92 is controlled to perform a binding process, that is, to bind the bundle of sheets PT. For example, if a binding process with the second binder 92 is manually selected and if, e.g., a sensor detects that the second binder 92 is not able to bind the bundle of sheets PT due to a failure of the second driver, the first binder 91 in good condition is controlled to bind the bundle of sheets PT. In such a case, an operation display panel of the image forming apparatus 1 displays a message as such.

This configuration prevents manual operation from being interrupted by the failure of the selected binding process.

In addition, this configuration is particularly advantageous as the movement of the movable guide 95 is not in conjunction with the movement of the first binder 91 and the second binder 92 as described above.

Referring now to FIGS. 7A through 10B, a description is given of a binding operation performed by the first binding device 90 with the first binder 91. In addition, referring to FIGS. 11A through 16B, a description is given of a binding operation performed by the first binding device 90 with the second binder 92.

FIGS. 7A, 8A, 9A, and 10A are schematic views of the main part of the first binding device 90 in the width direction thereof, that is, in the sheet width direction. On the other hand, FIGS. 7B, 8B, 9B, and 10B are schematic views of the main part of the first binding device 90 in the sheet conveyance direction. The binding operation of the first binding device 90 with the first binder 91 proceeds in this order starting from the state illustrated in FIGS. 7A and 7B.

Similarly, FIGS. 11A, 12A, 13A, 14A, 15A, and 16A are schematic views of the main part of the first binding device 90 in the width direction thereof, that is, in the sheet width direction. On the other hand, FIGS. 11B, 12B, 13B, 14B, 15B, and 16B are schematic views of the main part of the first binding device 90 in the sheet conveyance direction. The binding operation of the first binding device 90 with the second binder 92 proceeds in this order starting from the state illustrated in FIGS. 11A and 11B.

Note that, for the sake of simplicity, FIGS. 7A through 16B omit the movement of the first binder 91 and the second binder 92.

Referring now to FIGS. 7A through 10B, a description is given of the binding operation of the first binding device 90 with the first binder 91.

Figure 8A:
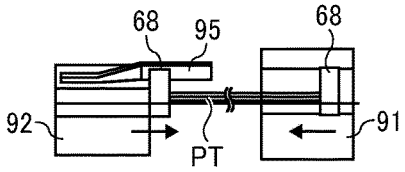
FIG. 8A is a schematic view of the binding device, illustrating a second stage of the binding operation thereof with the first binder in the sheet width direction.
Figure 8B:
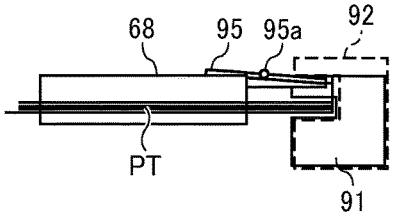
FIG. 8B is a schematic view of the binding device, illustrating the second stage of the binding operation thereof with the first binder in the sheet conveyance direction.
Figure 9A:
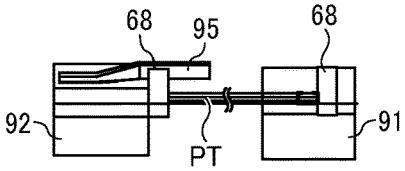
FIG. 9A is a schematic view of the binding device, illustrating a third stage of the binding operation thereof with the first binder in the sheet width direction.
Figure 9B:
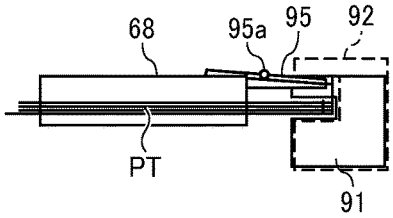
FIG. 9B is a schematic view of the binding device, illustrating the third stage of the binding operation thereof with the first binder in the sheet conveyance direction.
Figure 10A:
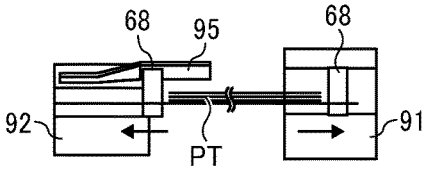
FIG. 10A is a schematic view of the binding device, illustrating a fourth stage of the binding operation thereof with the first binder in the sheet width direction.
Figure 10B:
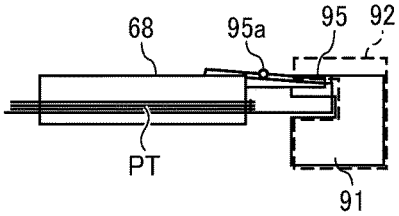
FIG. 10B is a schematic view of the binding device, illustrating the fourth stage of the binding operation thereof with the first binder in the sheet conveyance direction.

FIG. 7A is a schematic view of the first binding device 90, illustrating a first stage of the binding operation thereof with the first binder 91 in the sheet width direction. FIG. 7B is a schematic view of the first binding device 90, illustrating the first stage of the binding operation thereof with the first binder 91 in the sheet conveyance direction. FIG. 8A is a schematic view of the first binding device 90, illustrating a second stage of the binding operation thereof with the first binder 91 in the sheet width direction. FIG. 8B is a schematic view of the first binding device 90, illustrating the second stage of the binding operation thereof with the first binder 91 in the sheet conveyance direction. FIG. 9A is a schematic view of the first binding device 90, illustrating a third stage of the binding operation thereof with the first binder 91 in the sheet width direction. FIG. 9B is a schematic view of the first binding device 90, illustrating the third stage of the binding operation thereof with the first binder 91 in the sheet conveyance direction. FIG. 10A is a schematic view of the first binding device 90, illustrating a fourth stage of the binding operation thereof with the first binder 91 in the sheet width direction. FIG. 10B is a schematic view of the first binding device 90, illustrating the fourth stage of the binding operation thereof with the first binder 91 in the sheet conveyance direction.

Firstly, as illustrated in FIGS. 7A and 7B, a desired number of sheets P are stacked on the inner tray 61 as a bundle of sheets PT.

At this time, the left side fence 68 is located at a reference position to the right side of the movable guide 95 in FIG. 7A. That is, at this time, the left side fence 68 does not push the trailing end portion of the movable guide 95 from below. Specifically, the movable guide 95 includes a high ceiling portion serving as a first ceiling portion and a low ceiling portion serving as a second ceiling portion formed on the right side and the left side of the movable guide 95, respectively, in FIG. 7A. A relay ceiling portion is formed between the first ceiling portion and the second ceiling portion. The relay ceiling portion serves as an inclined ceiling portion that is inclined downward from the right side to the left side in FIG. 7A. The left side fence 68 is located at a position opposite the first ceiling portion of the movable guide 95 (or a position where the left side fence 68 lightly contacts the first ceiling portion of the movable guide 95).

In this state, as illustrated in FIG. 7B, the gap of the leading end portion of the movable guide 95 is $X1+\alpha$, which is larger than the size X1 of the entrance of the receiving portion of the first binder 91.

Then, as illustrated in FIGS. 8A and 8B, the two side fences of the side fence pair 68 individually move in the sheet width direction, thereby aligning the bundle of sheets PT in the sheet width direction on the inner tray 61.

Thereafter, as illustrated in FIGS. 9A and 9B, the bundle of sheets PT thus aligned is directed to the receiving portion of the first binder 91 so that the first binder 91 binds the bundle of sheets PT. As the trailing end portion of the bundle of sheets PT is regulated by the gap (i.e., $X1+\alpha$) of the leading end portion of the movable guide 95, the bundle of sheets PT is reliably directed to the receiving portion of the first binder 91.

After the first binder 91 binds the bundle of sheets PT, the side fence pair 68 separates from the bundle of sheets PT as illustrated in FIGS. 10A and 10B so as to release the bundle of sheets PT. Until this time, the gap (i.e., $X1+\alpha$) of the leading end portion of the movable guide 95 is maintained.

Referring now to FIGS. 11A through 16B, a description is given of the binding operation of the first binding device 90 with the second binder 92.

Figure 11A:
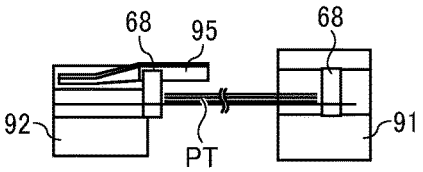
FIG. 11A is a schematic view of the binding device, illustrating a first stage of a binding operation thereof with the second binder in the sheet width direction.
Figure 11B:
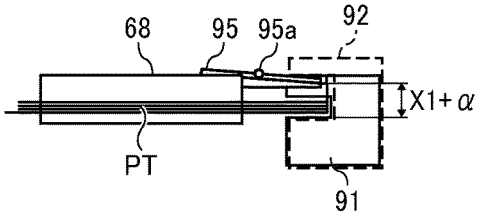
FIG. 11B is a schematic view of the binding device, illustrating the first stage of the binding operation thereof with the second binder in the sheet conveyance direction.

FIG. 11A is a schematic view of the first binding device 90, illustrating a first stage of a binding operation thereof with the second binder 92 in the sheet width direction. FIG. 11B is a schematic view of the first binding device 90, illustrating the first stage of the binding operation thereof with the second binder 92 in the sheet conveyance direction.

Figure 12A:
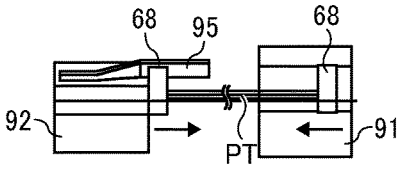
FIG. 12A is a schematic view of the binding device, illustrating a second stage of the binding operation thereof with the second binder in the sheet width direction.
Figure 12B:
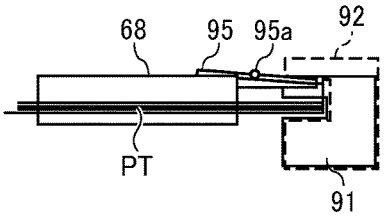
FIG. 12B is a schematic view of the binding device, illustrating the second stage of the binding operation thereof with the second binder in the sheet conveyance direction.
Figure 14A:
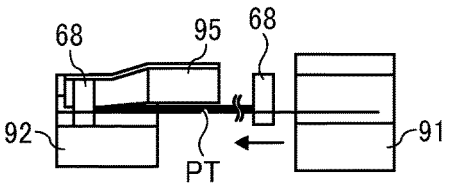
FIG. 14A is a schematic view of the binding device, illustrating a fourth stage of the binding operation thereof with the second binder in the sheet width direction.
Figure 14B:
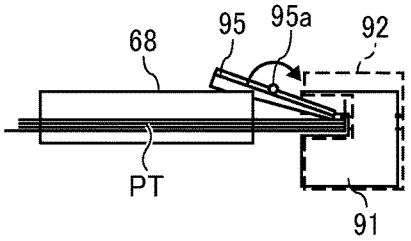
FIG. 14B is a schematic view of the binding device, illustrating the fourth stage of the binding operation thereof with the second binder in the sheet conveyance direction.
Figure 15A:
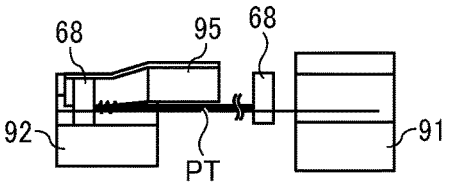
FIG. 15A is a schematic view of the binding device, illustrating a fifth stage of the binding operation thereof with the second binder in the sheet width direction.
Figure 15B:
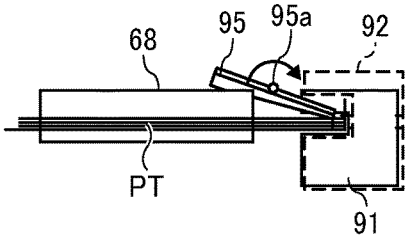
FIG. 15B is a schematic view of the binding device, illustrating the fifth stage of the binding operation thereof with the second binder in the sheet conveyance direction.
Figure 16A:
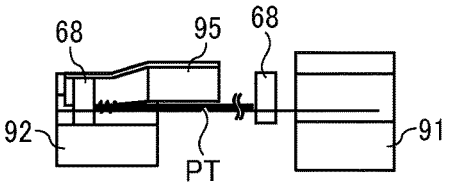
FIG. 16A is a schematic view of the binding device, illustrating a sixth stage of the binding operation thereof with the second binder in the sheet width direction.
Figure 16B:
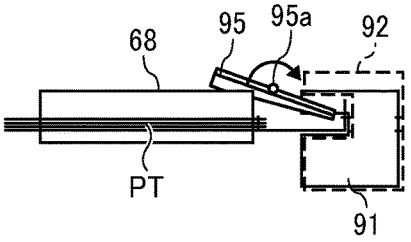
FIG. 16B is a schematic view of the binding device, illustrating the sixth stage of the binding operation thereof with the second binder in the sheet conveyance direction.

FIG. 12A is a schematic view of the first binding device 90, illustrating a second stage of the binding operation thereof with the second binder 92 in the sheet width direction. FIG. 12B is a schematic view of the first binding device 90, illustrating the second stage of the binding operation thereof with the second binder 92 in the sheet conveyance direction. FIG. 13A is a schematic view of the first binding device 90, illustrating a third stage of the binding operation thereof with the second binder 92 in the sheet width direction. FIG. 13B is a schematic view of the first binding device 90, illustrating the third stage of the binding operation thereof with the second binder 92 in the sheet conveyance direction. FIG. 14A is a schematic view of the first binding device 90, illustrating a fourth stage of the binding operation thereof with the second binder 92 in the sheet width direction. FIG. 14B is a schematic view of the first binding device 90, illustrating the fourth stage of the binding operation thereof with the second binder 92 in the sheet conveyance direction. FIG. 15A is a schematic view of the first binding device 90, illustrating a fifth stage of the binding operation thereof with the second binder 92 in the sheet width direction. FIG. 15B is a schematic view of the first binding device 90, illustrating the fifth stage of the binding operation thereof with the second binder 92 in the sheet conveyance direction. FIG. 16A is a schematic view of the first binding device 90, illustrating a sixth stage of the binding operation thereof with the second binder 92 in the sheet width direction. FIG. 16B is a schematic view of the first binding device 90, illustrating the sixth stage of the binding operation thereof with the second binder 92 in the sheet conveyance direction.

Firstly, as illustrated in FIGS. 11A and 11B, a desired number of sheets P are stacked on the inner tray 61 as a bundle of sheets PT.

At this time, the left side fence 68 is located at the reference position to the right side of the movable guide 95 in FIG. 11A. That is, at this time, the left side fence 68 does not push the trailing end portion of the movable guide 95 from below. In this state, as illustrated in FIG. 11B, the gap of the leading end portion of the movable guide 95 is X1+α, which is larger or wider than the size X1 of the entrance of the receiving portion of the first binder 91.

Then, as illustrated in FIGS. 12A and 12B, the two side fences of the side fence pair 68 individually move in the sheet width direction, thereby aligning the bundle of sheets PT in the sheet width direction on the inner tray 61. At this time, the gap of the leading end portion of the movable guide 95 is still wide (i.e., X1+α).

Thereafter, as illustrated in FIGS. 13A and 13B, the moving mechanism 98 moves the left side fence 68 to the left of the movable guide 95 in FIG. 13A, to the position where the left side fence 68 pushes the trailing end portion of the movable guide 95 from below. At this time, the left side fence 68 moves smoothly along the inclination of the inclined ceiling portion of the movable guide 95, and comes into contact with the second ceiling portion of the movable guide 95.

In this state, the movable guide 95 thus pushed by the left side fence 68 rotates in a clockwise direction about the pivot 95*a* in FIG. 11B. The gap of the leading end portion of the movable guide 95 changes to a narrow gap (i.e., X2+α), which is larger or wider than the size X2 of the entrance of the receiving portion of the second binder 92.

Thereafter, as illustrated in FIGS. 14A and 14B, the moving mechanism 98 moves the right side fence 68 to the left in FIG. 14A together with the bundle of sheets PT. Thus, the bundle of sheets PT is sandwiched between the two side fences of the side fence pair 68. At this time, the side fence pair 68 aligns the bundle of sheets PT again in the sheet width direction.

Thereafter, as illustrated in FIGS. 15A and 15B, the bundle of sheets PT thus aligned is directed to the receiving portion of the second binder 92 so that the second binder 92 binds the bundle of sheets PT. As the trailing end portion of the bundle of sheets PT is regulated by the narrow gap (i.e., X2+α) of the leading end portion of the movable guide 95, the bundle of sheets PT is reliably directed to the receiving portion of the second binder 92.

After the second binder 92 binds the bundle of sheets PT, the side fence pair 68 separates from the bundle of sheets PT as illustrated in FIGS. 16A and 16B so as to release the bundle of sheets PT. Until this time, the narrow gap ((i.e., X2+α) of the leading end portion of the movable guide 95 is maintained.

As described above, according to the present embodiment, the first binding device 90 includes the movable guide 95. When the first binder 91 binds the bundle of sheets PT, the movable guide 95 moves conforming to the maximum thickness of the bundle of sheets PT boundable in the first binder 91, so as to guide and direct the bundle of sheets PT to the receiving portion of the first binder 91. By contrast, when the second binder 92 binds the bundle of sheets PT, the movable guide 95 moves conforming to the maximum thickness of the bundle of sheets PT boundable in the second binder 92, so as to guide and direct the bundle of sheets PT to the receiving portion of the second binder 92. The movable guide 95 is movable in conjunction with the side fence pair 68 moved by the moving mechanism 98 in the width direction of the bundle of sheets PT.

Accordingly, without increasing the first binding device 90 in size and cost, the movable guide 95 is movable conforming to the entrance of the receiving portion of one of the first binder 91 and the second binder 92 that performs a binding process even if a mechanism that moves the other one of the first binder 91 and the second binder 92 fails. Note that, as described above, the maximum thickness of the bundle of sheets PT boundable in the first binder 91 is different from the maximum thickness of the bundle of sheets PT boundable in the second binder 92.

In the present embodiment, the monochrome image forming apparatus 1 includes the post-processing device 50 that includes the first binding device 90. Alternatively, a color image forming apparatus may include the post-processing device 50 that includes the first binding device 90 described above.

Further, in the present embodiment, the electrophotographic image forming apparatus 1 includes the post-processing device 50 that includes the first binding device 90. Alternatively, another type of image forming apparatus (e.g., inkjet image forming apparatus or a stencil printer) may include the post-processing device 50 that includes the first binding device 90 described above.

Furthermore, in the present embodiment, the post-processing device 50 includes the first binding device 90. Alternatively, the first binding device 90 may be independently disposed. In this case, for example, a sheet tray may be disposed adjacent to the sheet entrance 50*a* while the first binding device 90 may include an operation panel through which a processing mode and the like are inputted.

Any of the cases described above exhibits the same advantages as the advantages of the present embodiment.

In the present embodiment, another post-processing device may be disposed between the main body of the image forming apparatus 1 and the post-processing device 50 to perform, e.g., a Z-folding process on the sheet P.

Further, in the present embodiment, the post-processing device 50 is capable of performing a plurality of processes, namely, binding, sorting, and folding processes. Alternatively, the post-processing device 50 may be, e.g., a post-processing device capable of performing a punching process, a post-processing device capable of the binding process only of the plurality of processes described above, or a post-processing device capable of performing a plurality of processes not limited to the binding, sorting, and folding processes.

Furthermore, in the present embodiment, the first binder 91 performs a binding process with staples (e.g., metal staples) while the second binder 92 performs a binding process without staples (e.g., metal staples). Alternatively, the first binder 91 and the second binder 92 may be the same kind of binders or binders other than the combination described above, provided that the size of the entrance of the receiving portion of the first binder 91 (i.e., maximum thickness of the bundle of sheets boundable in the first binder 91) is different from the size of the entrance of the receiving portion of the second binder 92 (i.e., maximum thickness of the bundle of sheets boundable in the second binder 92).

Any of the cases described above exhibits the same advantages as the advantages of the present embodiment.

Note that the "sheet" serving as a recording medium includes not only a transfer sheet but also any kinds of sheet on which an image is formed. A "bundle of sheets" is defined as a bundle of such sheets.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

What is claimed is:

1. A binding device comprising:

a receptacle configured to stack a plurality of recording media as a bundle of recording media;

a first binder configured to bind the bundle of recording media on the receptacle;

a second binder configured to bind the bundle of recording media on the receptacle, a maximum thickness of the bundle of recording media boundable in the second binder being smaller than a maximum thickness of the bundle of recording media boundable in the first binder;

a guide movable conforming to the maximum thickness of the bundle of recording media boundable in the first binder to guide and direct the bundle of recording media stacked on the receptacle to a receiving portion of the first binder when the first binder binds the bundle of recording media;

an aligner configured to align a position of the bundle of recording media in a width direction of the bundle of recording media on the receptacle; and a moving mechanism configured to move the aligner in the width direction of the bundle of recording media, the guide being movable in conjunction with the aligner moved by the moving mechanism in the width direction of the bundle of recording media such that the aligner pushes and rotates the guide about a pivot in response to the moving mechanism moving the aligner in the width direction of the bundle of recording media, wherein the guide is movable conforming to the maximum thickness of the bundle of recording media boundable in the second binder to guide and direct the bundle of recording media stacked on the receptacle to a receiving portion of the second binder when the second binder binds the bundle of recording media.

2. The binding device according to claim 1, wherein the aligner includes a side fence.

3. The binding device according to claim 1, wherein the guide is rotatable about the pivot, and the aligner moved by the moving mechanism in the width direction of the bundle of recording media pushes and rotates the guide about the pivot.

4. The binding device according to claim 3, wherein the pivot is disposed between a leading end portion of the guide and a trailing end portion of the guide in a direction perpendicular to the width direction of the bundle of recording media, and the leading end portion of the guide is located on a binder side where the first binder and the second binder are located while the trailing end portion of the guide is located on an aligner side where the aligner is located.

5. The binding device according to claim 4, wherein when the first binder binds the bundle of recording media, the aligner does not push the trailing end portion of the guide while the leading end portion of the guide is located at a first position conforming to the maximum thickness of the bundle of recording media boundable in the first binder.

6. The binding device according to claim 4, wherein when the second binder binds the bundle of recording media, the aligner moved by the moving mechanism in the width direction of the bundle of recording media pushes the trailing end portion of the guide and rotates the guide about the pivot, and the leading end portion of the guide moves to a second position conforming to the maximum thickness of the bundle of recording media boundable in the second binder, and the second position is lower than a first position conforming to the maximum thickness of the bundle of recording media boundable in the first binder.

7. The binding device according to claim 6, wherein the second binder binds the bundle of recording media while the aligner pushes the trailing end portion of the guide to locate the leading end portion of the guide at the second position and while the aligner aligns the bundle of recording media in the width direction of the bundle of recording media.

8. The binding device according to claim 1, wherein in response to a failure of one of the first binder and the second binder, another one of the first binder and the second binder binds the bundle of recording media.

9. The binding device according to claim 1, wherein the first binder is configured to bind the bundle of recording media with a staple, and the second binder is configured to bind the bundle of recording media without a staple.

10. An image forming apparatus comprising:

the binding device according to claim 1.

11. The binding device according to claim 1, wherein the guide is rotatable about the pivot, and the moving mechanism is configured to move the aligner in the width direction of the bundle of recording media such that the aligner pushes and rotates the guide about the pivot.

12. The binding device of claim 11, wherein the moving mechanism is configured to move the aligner in the width direction of the bundle of recording media from a first position separated from the guide to a second position contacting the guide such that the aligner pushes and rotates the guide about the pivot.

13. The binding device according to claim 1, wherein the moving mechanism is configured to, move the aligner in the width direction of the bundle of recording media such that the aligner pushes and rotates the guide about the pivot, when the second binder is set to bind the bundle of sheets, remain stationary and not move the aligner to push and rotate the guide about the pivot, when the first binder is set to bind the bundle of sheets.

* * * * *